United States Patent [19]

Westerlund et al.

[11] Patent Number: 4,648,319

[45] Date of Patent: Mar. 10, 1987

[54] IGNITION DEVICE

[75] Inventors: Börje Westerlund, Kristinehamn; Arne Vestring, Karlskoga, both of Sweden

[73] Assignee: Aktiebolaget Bofors, Sweden

[21] Appl. No.: 733,831

[22] Filed: May 14, 1985

[30] Foreign Application Priority Data

May 14, 1984 [SE] Sweden ..... 8402572

[51] Int. Cl.[4] ..... F42C 11/00; F42B 3/02

[52] U.S. Cl. ..... 102/202.12; 102/202.5; 102/202.9

[58] Field of Search ..... 102/202.5–202.13

[56] References Cited

U.S. PATENT DOCUMENTS

| | | | |
|---|---|---|---|
| 1,034,160 | 7/1912 | Starkweather | 102/472 |
| 2,872,870 | 2/1959 | Grey | 102/202.13 |
| 4,267,567 | 5/1981 | Nygaard | 102/202.5 |
| 4,316,412 | 2/1982 | Dinegar et al. | 102/202.5 |
| 4,464,989 | 8/1984 | Gibson et al. | 102/202.5 |

FOREIGN PATENT DOCUMENTS

| | | | |
|---|---|---|---|
| 990138 | 1/1976 | Canada | 102/202.5 |
| 2945803 | 5/1981 | Fed. Rep. of Germany | 102/202.5 |
| 1252701 | 12/1960 | France | 102/202.5 |
| 1165053 | 9/1969 | United Kingdom | 102/202.5 |
| 2076944 | 12/1981 | United Kingdom | 102/202.5 |
| 2097517 | 11/1982 | United Kingdom | 102/202.13 |

*Primary Examiner*—Deborah L. Kyle

*Assistant Examiner*—Michael J. Carone

*Attorney, Agent, or Firm*—Pollock, Vande Sande & Priddy

[57] ABSTRACT

An ignition device comprising a lower housing (1) in which a sleeve (2) is mounted containing the main charge (10) of the ignition device. The ignition device utilizes an electric igniter device (15) which includes an insulating body (19), an electric pole device (20) and at least one electrically connecting element applied on one end surface (19*a*) of the insulating body for connecting the electric pole device (20) and the electric ignition device housing (21). The electric ignition device makes contact via the said end surface (19*a*), against the layers (16) and (17) of pyrotechnical charges included in the ignition chain for the main charge (10). The said electric ignition device and layers of pyrotechnical charges are located inside a ring-shaped device (12) from the first end of which the electric pole device (20) protrudes. The ring-shaped device extends into the recesses (1*a*) and (9*e*) in the lower housing (1) and the sealing part as well as across the space (13) between these parts. The sealing part (9) presses the pyrotechnical charges against the said end surface (19*a*) and the electrically connecting elements via the filler layer (18) in the ring-shaped device. The electric ignition device is fixed in and sealed against the ring-shaped device which in turn is sealed against the lower housing by means of laser welding.

11 Claims, 5 Drawing Figures

IGNITION DEVICE

TECHNICAL FIELD

The present invention relates to an ignition device comprising an electric igniter, a lower housing and a sleeve which contains a main ignition charge and can be fitted in the said housing. The said sleeve is provided with a sealing part or a lower/end-part which faces the lower housing. The electric igniter comprises an insulating body (glass body), an electric pole device and at least one electrically connecting element located on an end surface of the insulating body and which connects the electric pole device and the electric igniter housing. The electric igniter also contacts different ignition charges which form part of the sealing function for the said main charge, via the said surface and the electrically connecting elements.

BACKGROUND ART

There already exists several designs of ignition devices. An ignition device is intended to be fitted in a particular type of ammunition unit e.g., artillery or anti-aircraft ammunition. The ignition device may comprise an electric ignition circuit and ignition charges which can be activated by the heat produced by one or more electric igniter filaments fitted in the ignition device and which are electrified when the electric circuit is initiated. The ignition charge(s) are so arranged that when they are activated the main ignition charge in the ignition device is ignited.

There are even electric igniters which include a glass body containing a centrally located electric pole device and an end surface where the electically connecting element has the form of metal layers applied onto the end surface by vapourization under vacuum. In such an electric igniter the heat releasing properties can be very accurately predetermined.

DISCLOSURE OF THE INVENTION

TECHNICAL PROBLEMS

There is a desire to be able to fit electric igniters of the said or similar types in various types of ignition devices. In this context there is a demand that the electric igniter should be contained inside the ignition device so that in addition to its ignition function it also insulates against moisture and seals against the pressure created in the gun (e.g., up tc 500 Mpa). It is also important that a threaded, or bent, joint around the pyrotechnical charges can be eliminated thus preventing joints that loosen thereby causing accidental ignition of the ignition device. It must not be possible for the pyrotechnical charges to be displaced axially thus causing ignition by friction or the ignition charges to loose contact with the electrically connecting element.

SOLUTION

The object of this invention is to create a device which among other things solves those problems stated above. One of the main characteristics of this new device is that the said insulating body and ignition charges are located inside a ring-shaped device from the first end of which the said electric pole device protrudes, and that the ring-shaped device extends at least partially into a recess in the said lower housing. Another characteristic is that the said sealing part via a layer of filler in the ring-shaped device, presses the pyrotechnical charges against the said end surface and the electrically connecting element(s), and that the electric igniter is fixed to the ring-shaped device which in turn is fixed in the lower housing, e.g., via laser welding or some other method.

Further developments of the principle of this invention include, among other things, an extension of the ring-shaped device partially even into a recess in the sealing part of the said sleeve. The said sealing part also presses against the said layer of filler via for instance a bursting disc-type part. The sealing part is preferably made of aluminium or a similar metal and is relatively thin.

The ring-shaped device has metal-to-metal contact with the lower housing and/or the sealing part so that an electrical connection exists between the electric igniter, the ring-shaped device and the lower housing and/or the sealing part. The ignition device housing is connected electrically to a first potential. The electric igniter is initiated by transmitting a second potential to the electric pole device. The said potentials may be plus and minus potentials on a direct current source.

In a preferred embodiment of this invention the electric pole device extends via a recess in the lower housing so that it is accessible for application of the said second potential. One end of the electric pole device is centrally arranged in said insulating glass body and the other end is centered in said recess by means of a further insulating member. Further means have also been included for increasing the contact surface for said second potential. The electric pole device has the form of a rod which can be deformed when the second potential makes contact, so that in this way axially forces in the electric igniter are prevented.

ADVANTAGES

According to the proposed embodiment the igniting device is built into a very solid unit in which the ignition charges are given a distinct contact against the end surface of the electric igniter and the electrically connecting element on it. Axial movement of the ignition charges cannot take place thus preventing friction ignition and separation from the electrically connecting element. The entire unit can be carried out with relatively few parts thus contributing to simpler and safer manufacturing. Insulation and sealing functions are provided for and safety is ensured even in those cases where the ignition device is rammed more than once.

In addition, the contact resistance will be small in the electric circuits which will be established between the parts affected. The fixation between the electric igniter and the ring-shaped device on the one side, and the ring-shaped device and the lower housing on the other side, provides particular advantages as no heat is developed when the parts are joined to each other.

In the preferred embodiment having an increased contact surface for the second potential applied on the other end of the electric pole device preferably laser welding is used for connecting the contact disc with said electric pole device. The sleeve and lower housing may also be fixed to each other by means of laser welding if "Loctite" should prove to be insufficient.

BRIEF DESCRIPTION OF THE DRAWINGS

One embodiment of the present invention will now be described with reference to the accompanying drawings in which.

PREFERRED EMBODIMENT

Figure 2:
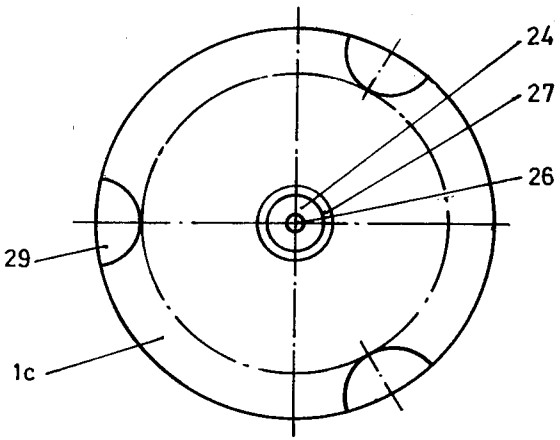
FIG. 2 is an end view of the ignition device according to FIG. 1.
Figure 1:
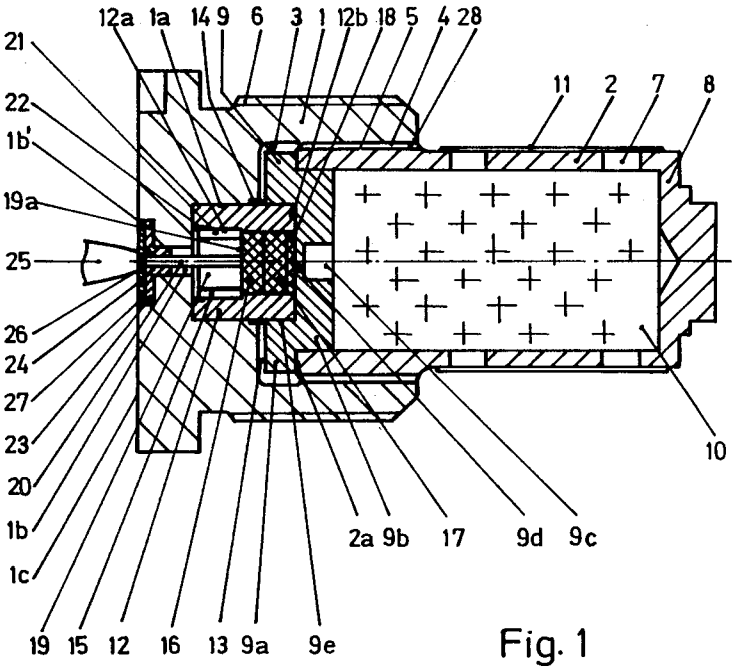
FIG. 1 is a longitudinal section of an ignition device according to the invention.
Figure 3:
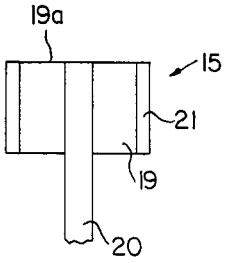
FIGS. 3, 4 and 5 are enlarged sectional views of portions of the ignition device of FIG. 1.
Figure 4:
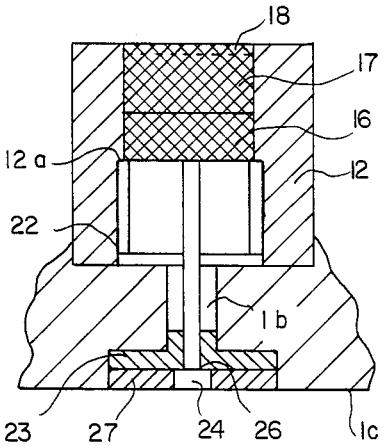
Figure 5:
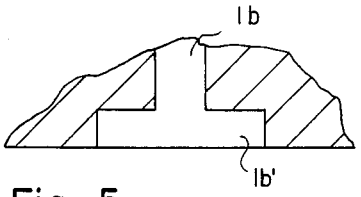

This invention can for instance be used in an ignition device having a lower housing 1 and a sleeve 2. The lower housing is provided with a recess 3 having an internal thread 4 into which the sleeve 2 can be screwed. The lower housing is also provided with an external thread 6 via which the ignition device can be screwed into a projectile or other type of ammunition unit. The mantle of the sleeve 2 is provided with through outlet holes 7. The said sleeve also has a first end part or sealing part 8 and a second end part or sealing part 9. The sleeve contains the main ignition charge 10 which may be composed of black powder or some other pyrotechnical charge. The sealing part 9 has a first part **9*a* which covering the end surface 2*a* and also a part 9*b* which protrudes downwards inside the wall of the sleeve. The sealing part 9 is loose in relation to the wall of the sleeve 2. A shrunk-on tube is fitted on the outside of the sleeve so that it covers the exhaust outlets 7. The sealing part 9 is also provided with a central recess 9*c* the bottom of which functions as a bursting disc 9*d*. The sealing part 9 is made of aluminium and the bursting disc has a thickness of 0.5 mm approximately. On the opposite side and facing the recess 9*c* the sealing part is provided with a further recess 9*e***.

The lower housing 1 is also provided with a central recess **1*a* and an other recess 1*b* which connects with said central recess 1*a* but which has a considerably smaller cross-section than the latter. The latter recess opens out towards the end surface 1*c* of the lower housing. The opened-out part of the recess 1*b* is designated 1*b*'**.

A ring-shaped device 12 is fitted in the recesses **1*a* and 9*e*. The expression "ring-shaped device" should be seen in its widest sense and includes types of bushings, hollow cylinders, and similar. The said ring-shaped device extends partly into the recess 1*a* and partly into the recess 9*e*. This ring-shaped device also extends over a space 13 between the outer end surface of the sealing part 9 and the bottom surface of the lower housing 1 inside the recess 3**.

The said ring-shaped device is fitted in the recesses **1*a* and 9*e* to ensure electrical contact between the ring-shaped device 12 and the lower housing 1 and between the ring-shaped device and the sealing part 9. The ring-shaped device is fixed in the lower housing by means of laser welding 14 which has the additional purpose of sealing the space between the ring-shaped device and the lower housing. The laser welding may be carried out by known methods and equipments and has the advantage that only a small amount of heat is developed during the actual welding. The ring-shaped device is so formed that it contains an electric igniter 15 and two pyrotechnical charges 16 and 17. In order to fill any possible space between the inner pyrotechnical charge 17 and the bursting disc 9*d* there is an inert layer of filler 18**.

The said electric igniter may be of any known type e.g., the electric igniter described in the Swedish Pat. specification No. 431 681. The said electric igniter will not be described in more detail here, it should only be said that it comprises a glass body 19 and a centrally extending electric pole device 20 made of an electrically conductive material. The glass body 19 has an end surface **19*a* onto which, although not specifically shown, electrically connecting elements in the form of metal layers are applied by means of vapourization so that they extend between the electric pole device 20 and a part 21 which surrounds the glass body and is made of an electrically conductive material. The said electrically connecting elements thus form an electric circuit which is activated by an electric current being led through the electric pole device, the connecting elements and the said part 21. The electric igniter is completely located inside the ring-shaped device 12 which has an inner supporting surface 12*a* on which the inner edge of the part 21 is seated. The electric igniter is fixed to the ring-shaped device by means of a laser weld 22 at the other end surface (via the part 21**) of the electric igniter, and consequently the said other end surface extends inside the inner edges of the ring-shaped device.

The electric pole device 20 extends into the recess **1*b* and out to the end surface 1*c* of the lower housing. Inside the opened-out part 1*b*' of the recess 1*b* is located a centering device 23 made of an insulating material. The said material may be plastic. Outside the device 23 is located a washer 24 made of an electrically conducting material. The said washer is intended to form an extended contact surface for an impact device 25 via which a potential is transmitted to the electric pole device when the electric igniter is activated. The said washer 24 is fixed in the electric pole device by means of a laser weld 26. The outer edges of the said washer are sealed by means of an epoxy plastic seal 27**.

The pyrotechnical ignition charges 16 and 17 can be of a type used in ignition devices. One or more ignition charges or layers may be used. The inert layer 18 may consist of antimony powder.

The said layer of filler 18 ensures that the charges 16 and 17 are always pressed against the end surface of the electric igniter. The layer of filler lies flush with the end surface **12*b***.

When manufacturing the ignition device according to this invention the electric igniter 15 is placed in the ring-shaped device 12 and then welded in position by means of laser weld 22. The ring-shaped device is then welded in the recess **1*a* by means of the laser weld 14. The layers 16, 17 and 18 are then laid in position whereupon the layer 18 is levelled out until it completely fills the space remaining between the outer charge 17 and the end surface 12*b* of the ring-shaped device. The sealing part 9 is then laid in position and tightened together with the sleeve 2 when fitting into the lower housing. If the sealing part 9 should turn (move) when fitting the sleeve 2 a possible friction ignition is prevented by the layer 18 of antimony powder. From the safety point of view this is a great advantage as the sealing part 9 can not cause friction ignition of the charges 16 and 17. The insulating centering device 23 is placed in the recess 1*b*' and the conducting washer 24 is placed on top of the centering device and then welded in position by means of the laser weld 26**.

The laser welds 14, 22 and 26 prevent moisture penetrating the ignition charges 16 and 17. The contact resistances between the various parts will be minimal.

When fitted in an actual ammunition unit the lower housing 1 is connected to a first potential on a utilized source of energy. When the ignition device is activated a second potential is transmitted to the impact device 25. An electric circuit is formed between the electric pole device 20, the electrically connecting elements, the part 21 via 22 on the electric igniter and further to the ring-shaped device 12 which like the lower housing 1 is made of electrically conductive material. The electric energy through the connecting elements causes heat to develop which in turn ignites the charges 16 and 17. The energy developed from the said charges causes the part 9*d* to be blown aside and the gases developed from the charges are able to ignite the main charge 10. When the charge 10 ignites hot gases are developed which flow out through the holes 7 and ignite the ammunitions' propellant charge.

A "Loctite" seal can be formed between the sleeve 2 and the lower housing 1. If so required a laser weld 28 can be made between the said parts. FIG. 2 shows the recesses 29 for a key member in the rear surface 1*c*. The rod-shaped electric pole device 20 may be provided with wedge-shaped recesses which weaken the electric pole device 20 that it deforms when the device 25 is struck on impact. In such case the said weakenings are made in such a way that the electric igniter is prevented from moving axially when the device 25 impacts and at the same time retaining electrical contact. This invention is not limited to the above embodiment but can be varied within the scope of the following claims.

We claim:

1. An ignition device comprising:

a said lower housing housing (1) provided with a recess (1*a*);

a sleeve (2) which is secured to said lower housing (1) and which contains a main ignition charge (10), and a sealing part (9) which faces said lower housing (1); and an electric igniter (15) said electric igniter (15) comprising an insulating body (19) having an end surface (19*a*), an electric pole device (20), and an electric igniter housing (21), and at least one electrically connecting element located on said end surface (19*a*) of said insulating body (19) and interconnecting the electric pole device (20) and the electric igniter housing (21), said end surface (19*a*) and said electrically connecting element contacting one of pyrotechnical charges (16,17) included in the ignition chain for a main ignition charge (10);

wherein said electric igniter (15) and pyrotechnical charges (16,17) are located inside a ring-shaped device (12), said ring-shaped device (12) having a first end from which said electric pole device protrudes, said ring-shaped device (12) extending at least partly into said recess (1*a*) in the said lower housing (1), and wherein said sealing part (9) presses said pyrotechnical charges (16,17) against said end surface (19*a*) and the electrically connecting element of the electric igniter through a filler layer (18) in said ring-shaped device (12), and wherein said electric igniter (15) is secured to said ring-shaped device (12) and said ring-shaped device (12) is secured to said lower housing (1).

2. An ignition device according to claim 12 wherein said sealing part (9) is provided with a recess (9*e*) and said ring-shaped device (12) partly extends into said recess (9*e*) in the sealing part (9).

3. An ignition device according to claims 1 or 2 wherein said the sleeve (2) and lower housing (1) are provided with mating threads for securing said sleeve and said housing together and said sleeve can be locked to the lower housing and said sealing part (9) is loose in relation to a wall of the sleeve (2).

4. An ignition device according to claims 1 or 2 wherein said ring-shaped device (12) is fixed to the lower housing (1) and the sealing part (9) so that a reliable electrical connection is established between the ring-shaped device and the lower housing and the sealing part.

5. An ignition device according to claims 1 or 2 wherein said sealing part (9) presses against the filler layer (18) via a bursting disc part (9*d*).

6. An ignition device according to claim 5 characterized in that the filler layer (18) consists of an inert material, in order to prevent any possible friction ignition when mounting the sealing part (9).

7. An ignition device according to claim 1 wherein said electric pole device (20) extends through the recess (1*b*) in the lower housing so that it is accessible to an electric contact device (25) by means of which the electric igniter (19) is activated.

8. An ignition device according to claim 7 wherein said electric pole device (20) is pin-shaped and can be deformed when the contact device (25) impacts against it.

9. An ignition device according to claims 7 or 8 wherein said electric pole device (20) at its end adjacent the insulating body (19) is centered in its recess by means of a centering device (23) made of electrically insulating material.

10. An ignition device according to any one of claims 7 or 8 wherein said electric pole device (20) is provided with an outer end which is connected to a washer (24) made of electrically conductive material for providing a wide contact surface for the contact device (25).

11. An ignition device according to claim 10 wherein said washer (24) is fixed by means of laser welding.

* * * * *